US010457073B2

(12) United States Patent
Okuda et al.

(10) Patent No.: US 10,457,073 B2
(45) Date of Patent: Oct. 29, 2019

(54) INK JET RECORDING METHOD

(71) Applicant: Seiko Epson Corporation, Tokyo (JP)

(72) Inventors: Ippei Okuda, Shiojiri (JP); Mitsuaki Kosaka, Minowa (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 15/854,235

(22) Filed: Dec. 26, 2017

(65) Prior Publication Data

US 2018/0244078 A1 Aug. 30, 2018

(30) Foreign Application Priority Data

Feb. 24, 2017 (JP) ..... 2017-033491

(51) Int. Cl.
*B41J 11/00* (2006.01)
*B41J 2/21* (2006.01)
*B41M 5/00* (2006.01)

(52) U.S. Cl.
CPC ..... *B41J 11/0015* (2013.01); *B41J 2/2103* (2013.01); *B41J 2/2114* (2013.01); *B41J 2/2132* (2013.01); *B41M 5/0017* (2013.01); *B41M 5/0047* (2013.01); *B41M 5/0011* (2013.01); *B41M 5/0058* (2013.01); *B41M 5/0064* (2013.01)

(58) Field of Classification Search
CPC .... B41J 11/0015; B41J 2/2103; B41J 2/2114; B41J 2/2132; B41M 5/0017; B41M 5/0047; B41M 5/0011; B41M 5/0058; B41M 5/0064
See application file for complete search history.

(56) References Cited

U.S. PATENT DOCUMENTS 5,864,350 A 1/1999 Shioya et al.
2010/0196604 A1* 8/2010 Kariya ..... C09D 11/322 427/288
2014/0043393 A1 2/2014 Takeuchi
2016/0303873 A1* 10/2016 Okuda ..... B41M 5/0017

FOREIGN PATENT DOCUMENTS

JP 11-138866 A 5/1999
JP 3190535 B2 7/2001
JP 2014-034167 A 2/2014

* cited by examiner

*Primary Examiner* — Jason S Uhlenhake
(74) *Attorney, Agent, or Firm* — Harness, Dickey & Pierce, P.L.C.

(57) ABSTRACT

An ink jet recording method according to one aspect of the invention includes a reaction liquid adhesion step of ejecting from an ink jet head, a reaction liquid in the form of liquid droplets containing an aggregating agent which aggregates a color ink composition so as to adhere the reaction liquid to a recording region of a recording medium which is a non-absorptive recording medium or a low-absorptive recording medium; and a color ink adhesion step of ejecting the color ink composition in the form of liquid droplets from the ink jet head so as to adhere the color ink composition to the recording region of the recording medium to which the reaction liquid is adhered. In the reaction liquid adhesion step, while ejecting the liquid droplets, the ink jet head is scanned a plurality of times so as to be moved relatively with respect to the recording medium.

15 Claims, 2 Drawing Sheets

INK JET RECORDING METHOD

BACKGROUND

1. Technical Field

The present invention relates to an ink jet recording method.

2. Related Art

Since an ink jet recording method is able to record a highly fine image by a relatively simple apparatus, techniques relating to this recording method have been rapidly developed in various fields. In particular, various studies on ejection stability and the like have been carried out. For example, JP-A-2014-34167 has disclosed an ink jet recording method which includes a pre-treatment liquid application step of applying to a recording medium, a pre-treatment liquid (reaction liquid) which contains an organic solvent, water, and an aggregating agent aggregating a color material component of an ink; and an ink ejection step of performing an ink-jet ejection of an ink containing a color material and water onto the recording medium.

SUMMARY

When the ink jet recording method using a reaction liquid described above is applied to a non-absorptive recording medium or a low-absorptive recording medium, each of which functions as a recording medium, it was found that an image quality is influenced by an adhesion state of the reaction liquid on the recording medium. When the amount of the reaction liquid applied onto the recording medium is small, an area in which the recording medium is exposed is increased, and as a result, the reaction liquid and the ink are not allowed to react with each other. In addition, when the amount of the reaction liquid applied onto the recording medium is increased, reaction liquid droplets tend to gather together on the recording medium, and as a result, the distribution of the reaction liquid on the recording medium becomes uneven. In any case, even if the total adhesion amount of the reaction liquid per unit area is sufficiently secured, when the reaction liquid cannot be uniformly applied onto the recording medium, the image quality of a final recorded material tends not to be improved.

An advantage of some aspects of the invention is that in an ink jet recording method using a reaction liquid for a recording medium which is a non-absorptive recording medium or a low-absorptive recording medium, an ink jet recording method capable of improving the image quality is provided.

In order to overcome the problems described above, intensive research was carried out by the present inventors. As a result, in an ink jet recording method using a reaction liquid for a recording medium which is a non-absorptive recording medium or a low-absorptive recording medium, in order to uniformly apply the reaction liquid onto the recording medium while the total adhesion amount of the reaction liquid per unit area is sufficiently secured, it was found effective that the reaction liquid is adhered to the recording medium by scanning performed a plurality of times.

According to one aspect of the invention, an ink jet recording method comprises: a reaction liquid adhesion step of ejecting from an ink jet head, a reaction liquid in the form of liquid droplets containing an aggregating agent which aggregates a color ink composition so as to adhere the reaction liquid to a recording region of a recording medium which is a non-absorptive recording medium or a low-absorptive recording medium; and a color ink adhesion step of ejecting the color ink composition in the form of liquid droplets from the ink jet head so as to adhere the color ink composition to the recording region of the recording medium to which the reaction liquid is adhered. In addition, in the reaction liquid adhesion step, while ejecting the liquid droplets, the ink jet head is scanned a plurality of times so as to be moved relatively with respect to the recording medium.

According to the structure described above, while the total adhesion amount of the reaction liquid per unit area is sufficiently secured, the reaction liquid can be uniformly applied onto the recording medium, and in every recording region of the recording medium, the reaction liquid and the color ink composition can be mixed with each other. As a result, the image quality, such as color stability, a covering property, and an anti-bleeding property, can be improved.

The recording medium in the reaction liquid adhesion step preferably has a surface temperature of 45° C. or less. Accordingly, the reaction liquid is suppressed from being rapidly dried, the dry state of the reaction liquid adhered to the recording region of the recording medium by scanning performed a plurality of times can be uniformly maintained, so that the image quality can be improved. In addition, the ink composition in the ink jet head can be suppressed from being dried, so that clogging of the head can be prevented.

In the reaction liquid, the content of an organic solvent having a normal boiling point of more than 250° C. is preferably 1 percent by mass or less, and the content of an organic solvent having a normal boiling point of 180° C. to 250° C. is preferably 3 percent by mass or more. Since the content of the organic solvent having a normal boiling point of more than 250° C. is 1 percent by mass or less, when the reaction liquid is mixed with the ink composition, the organic solvent can be rapidly evaporated, and in an ink non-absorptive recording medium or an ink low-absorptive recording medium, sufficient image quality and abrasion resistance can be obtained. In addition, since the content of the organic solvent having a normal boiling point of 180° C. to 250° C. is 3 percent by mass or more, evaporation of the organic solvent contained in the reaction liquid in the head can be prevented, so that clogging of nozzles can be prevented. In addition, when the reaction liquid is mixed with the ink composition on the recording medium, the organic solvent can be rapidly evaporated, and in the ink non-absorptive recording medium or the ink low-absorptive recording medium, a sufficient image quality can be obtained.

For example, the number of scanning performed in the reaction liquid adhesion step is preferably 2 to 10 times. Accordingly, while the adhesion amount of the reaction liquid per one scanning is decreased, the total adhesion amount of the reaction liquid per unit area can be secured, and the image quality in the recording region of the recording medium can be improved.

The total adhesion amount of the reaction liquid in the recording region is preferably 4 mg/inch$^2$ or less, and the adhesion amount of the reaction liquid per one scanning is preferably 0.1 to 2 mg/inch$^2$. When the total adhesion amount of the reaction liquid in the recording region is more than 4 mg/inch$^2$, since the moisture in the reaction liquid is excessive, the rate of reaction with the color ink composition is increased, and as a result, the covering property tends to be degraded. Since the adhesion amount of the reaction liquid per one scanning is 0.1 to 2 mg/inch$^2$, aggregation caused by contact between reaction liquid droplets can be suppressed, and the reaction liquid can be uniformly adhered to the recording region of the recording medium.

For example, the content of the aggregating agent of the reaction liquid is preferably 0.5 to 15 percent by mass. Accordingly, while the image quality is improved, the balance with other characteristics, such as abrasion resistance, can be obtained.

The mass of the reaction liquid per one liquid droplet in the reaction liquid adhesion step is preferably 10 ng/dot or less. Accordingly, the aggregation caused by contact between the reaction liquid droplets can be suppressed, and the reaction liquid can be uniformly adhered to the recording region of the recording medium.

For example, the aggregating agent is preferably at least one of a polyvalent metal salt, an organic acid, and a cationic compound. Accordingly, the component of the ink composition can be aggregated by contact with the reaction liquid, and as a result, the image quality can be improved.

For example, the maximum adhesion amount of the color ink composition is preferably 5 to 15 mg/inch$^2$. Accordingly, the component of the ink composition can be sufficiently aggregated by contact with the reaction liquid, and as a result, the image quality can be improved.

For example, the ink jet recording method described above may further comprise: pre-heating the recording medium by a pre-heater provided at an upstream side in a recording medium transportation direction than a platen which supports the recording medium when the reaction liquid is adhered thereto; and transporting the pre-heated recording medium to the platen. Since the recording medium is heated by the pre-heater, evaporation rates of the moisture and the organic solvent contained in the reaction liquid on the recording medium can be adjusted.

For example, the reaction liquid adhesion step is performed by the scanning and sub-scanning which performs relative movement between the ink jet head and the recording medium in a direction intersecting the scanning direction, and the scanning is performed a plurality of times in the recording region of the recording medium in which the distance in the sub-scanning direction is a movement distance in the sub-scanning direction by one sub-scanning.

BRIEF DESCRIPTION OF THE DRAWINGS

The invention will be described with reference to the accompanying drawings, wherein like numbers reference like elements.

DESCRIPTION OF EXEMPLARY EMBODIMENT

Figure 1:
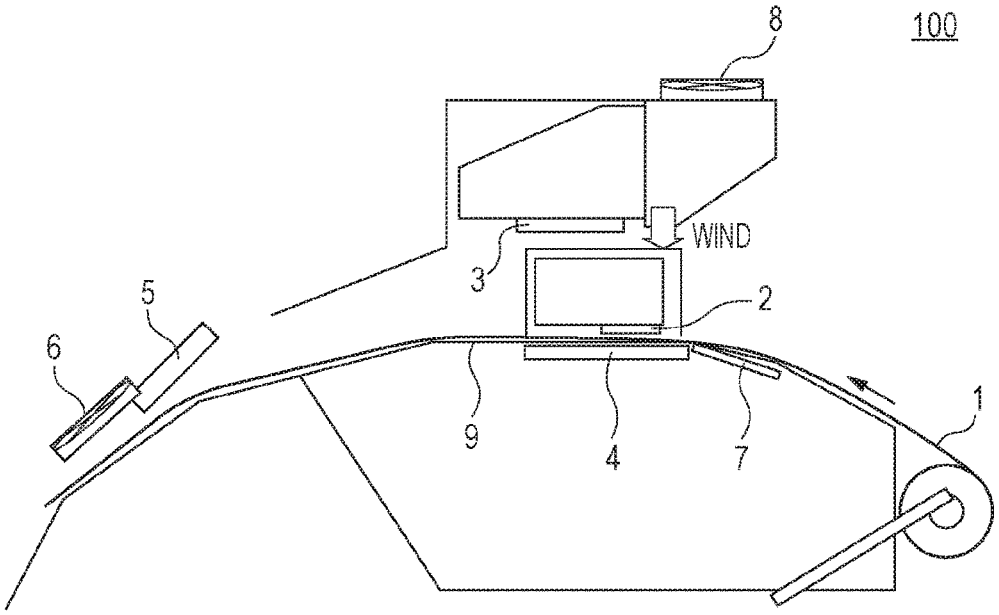
FIG. 1 is a schematic view of an ink jet apparatus used for an ink jet recording method of this embodiment.

Hereinafter, although an embodiment (hereinafter, referred to as "this embodiment") of the invention will be described in detail with reference to the drawings if needed, the invention is not limited thereto and may be variously changed without departing from the scope of the invention. In addition, in the drawings, the same element is designated by the same reference numeral, and duplicated description will be omitted. In addition, the positional relationship, such as up to down and left to right, is based on the positional relationship shown in the drawing unless otherwise particularly noted. Furthermore, the dimensional ratio in the drawing is not limited to the ratio shown in the drawing.

Hereinafter, after a reaction liquid, an ink composition, a recording medium, and an ink jet apparatus used for an ink jet recording method of this embodiment are described, the ink jet recording method of this embodiment will be described.

Reaction Liquid

The reaction liquid contains an aggregating agent which aggregates the ink composition. The reaction liquid is adhered to the recording medium before the ink composition is adhered thereto. Since the reaction liquid is adhered to the recording medium in advance, compared to the case in which the ink composition is directly adhered to the recording medium, the image quality can be improved. Hereinafter, components of the reaction liquid will be described.

Aggregating Agent

The aggregating agent reacts with one of the components contained in the ink composition and preferably reacts with one of a color material and a resin, so that a function of aggregating the color material together with the resin contained in the ink composition is obtained.

Accordingly, after ink droplets are landed, since the color material contained therein is aggregated, and the ink droplets are thickened, the interference therebetween can be suppressed, so that an image having no density irregularity can be formed.

As the aggregating agent, any one of a polyvalent metal salt, an organic acid, and a cationic compound is preferable, any one of the two former compounds is more preferable, and the first compound is further preferable. The content of the aggregating agent contained in the reaction liquid is preferably 1 to 20 percent by mass. Accordingly, the ink composition can be aggregated, and the image quality can be improved.

The polyvalent metal compound is a compound formed of a polyvalent metal ion having a valence of 2 or more and an anion. As the polyvalent meal ion having a valence of 2 or more, for example, $Ca^{2+}$, $Mg^{2+}$, $Cu^{2+}$, $Ni^{2+}$, $Zn^{2+}$, or $Ba^{2+}$ may be mentioned. As the anion, for example, $Cl^-$, $NO_3^-$, $CH_3COO^-$, $I^-$, $Br^-$, or $ClO_3^-$ may be mentioned. Among those ions mentioned above, since the above aggregating effect can be further enhanced, a magnesium salt, calcium salt, and an aluminum salt may be preferably used.

Although the organic acid is not particularly limited, for example, succinic acid, acetic acid, propionic acid, and a lactic acid may be mentioned.

Although the cationic compound is not particularly limited, a cationic polymer, a cationic surfactant, and the like may be used, and for example, a cationic polymer, such as a polyallylamine or a quaternary salt thereof, which is water-soluble and is positively charged in water may be mentioned.

The content of the aggregating agent in the reaction liquid is preferably 0.5 to 15 percent by mass. The content of the aggregating agent in the reaction liquid based on the mole concentration is 0.1 to 1.5 mol/kg. The lower limit of the content of the aggregating agent in the reaction liquid is more preferably 0.3 mol/kg or more. The upper limit of the content of the aggregating agent in the reaction liquid is more preferably 1.0 mol/kg or less and further preferably 0.5 mol/kg or less. Accordingly, while the image quality is improved, the balance with other characteristics, such as the abrasion resistance, can be obtained.

Organic Solvent Having Normal Point of 180° C. to 250° C.

The reaction liquid preferably contains an organic solvent having a normal boiling point of 180° C. to 250° C. Accordingly, evaporation of the organic solvent contained in the reaction liquid in the head is prevented, and clogging of nozzles can be prevented. In addition, when the reaction liquid is mixed with the ink composition on the recording medium, the organic solvent can be rapidly evaporated, and in an ink non-absorptive recording medium or an ink low-absorptive recording medium, a sufficient image quality can be obtained.

As the organic solvent, a nitrogen-containing solvent may also be contained. Accordingly, the resin in the ink composition can be stably dissolved, and the reaction liquid can be mixed with the ink composition. In addition, the nitrogen-containing solvent has a function to promote softening of resin particles contained in the ink composition and tends to improve the adhesion even when the heating temperature is low.

Although the nitrogen-containing solvents are not particularly limited, for example, there may be mentioned a pyrrolidone-based, an imidazolidinone-based, an amide ether-based, a pyridine-based, a pyradine-based, and a pyridone-based solvent. In addition, the pyrrolidone-based solvent is preferable, and for example, 2-pyrrolidone, N-methyl-2-pyrrolidone, and N-ethyl-2-pyrrolidone may be mentioned. The nitrogen-containing solvents may be used alone, or at least two thereof may be used in combination.

As the above organic solvent, other organic solvents other than the nitrogen-containing solvents may also be contained. The other organic solvents mentioned above are each preferably a polyol compound, more preferably an alkanediol, and further preferably an alkanediol having 3 to 7 carbon atoms. Although the other organic solvents are not particularly limited, for example, there may be concretely mentioned an alcohol and a glycol, such as ethylene glycol, diethylene glycol, triethylene glycol, ropylene glycol, dipropylene glycol, 1,3-propanediol, 1,2-butandiol, 1,2-pentanediol, 1,2-hexanediol, 1,4-butanediol, 1,5-pentanediool, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol monobutyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol. Those solvents may be used alone, or at least two types thereof may be used in combination.

The content of the organic solvent having a normal boiling point of 180° C. to 250° C. is, with respect to the total mass of the reaction liquid, preferably 3.0 percent by mass or more, more preferably 5.0 to 35 percent by mass, further preferably 10 to 35 percent by mass, and even further preferably 15 to 30 percent by mass. Accordingly, when the ink composition and the reaction liquid are mixed together, the degree of aggregation of the components of the ink composition is appropriately controlled. In addition, when the ink composition and the reaction liquid are mixed together on the recording medium, the organic solvent can be rapidly evaporated, and in the ink non-absorptive recording medium or the ink low-absorptive recording medium, a sufficient image quality can be obtained.

Organic Solvent Having Normal Boiling Point of More Than 280° C.

In the reaction liquid, the content of an organic solvent having a normal boiling point of more than 280° C. is preferably 1 percent by mass or less. When the reaction liquid contains the organic solvent having a normal boiling point of more than 280° C., the drying property of the reaction liquid on the recording medium is seriously degraded. As a result, in various recording media, and in particular, in the ink non-absorptive recording medium or the ink low-absorptive recording medium, bleeding of the image is not only apparently observed but also the abrasion resistance of the ink cannot be obtained.

The content of the organic solvent having a normal boiling point of more than 280° C. in the reaction liquid is, with respect to the total mass of the reaction liquid, preferably 0.5 percent by mass or less, more preferably 0 to less than 0.1 percent by mass, even more preferably 0 to less than 0.05 percent by mass, further preferably 0 to less than 0.01 percent by mass, and most preferably 0 to less than 0.001 percent by mass. When the content is in the range described above, the abrasion resistance of a recorded material is suppressed from being degraded by the organic solvent having a normal boiling point of more than 280° C., and a recorded material more excellent in abrasion resistance can be obtained.

Surfacatant

The reaction liquid preferably contains a surfactant. Although the surfactant is not particularly limited, for example, an acetylene glycol-based surfactant, a fluorine-containing surfactant, and a silicone-based surfactant may be mentioned. Among those surfactants, the acetylene glycol-based surfactant and the silicone-based surfactant are preferable. As those surfactants, the same surfactant as that of the ink composition may also be used.

The content of the surfactant is, with respect to 100 percent by mass of the reaction liquid, preferably 0.1 to 2.0 percent by mass, more preferably 0.1 to 1.7 percent by mass, and further preferably 0.1 to 1.5 percent by mass.

Water

The reaction liquid contains water. As the water, for example, there may be mentioned pure water, such as ion-exchanged water, ultrafiltrated water, reverse osmosis water, or distilled water, or water, such as ultrapure water, in which ionic impurities are removed as much as possible. In addition, when water sterilized, for example, by UV irradiation or by addition of hydrogen peroxide is used, in the case of long-term storage of a pigment dispersion liquid and an ink using the same, the generation of fungi and bacteria can be suppressed.

Although the content of the water is not particularly limited, the reaction liquid preferably contains water in an amount larger than that of the organic solvent. The content of the water is, with respect to 100 percent by mass of the reaction liquid, preferably 40 to 95 percent by mass, more preferably 45 to 90 percent by mass, and further preferably 50 to 80 percent by mass.

The reaction liquid may also contain components, such as a resin, a glue agent (such as a starch, a cellulose, a polysaccharide, a protein, or a water-soluble polymer), a pH adjuster, and an antiseptic agent/fungicide.

Color Ink Composition

The color ink composition (ink composition) of this embodiment is an aqueous ink-jet ink composition. Hereinafter, components contained in the ink composition will be described.

Color Material

Although a pigment or a dye may be used as the color material, a pigment is preferably used. Although the pigment is not particularly limited, for example, the following may be mentioned.

Although a black pigment is not particularly limited, for example, there may be mentioned No. 2300, No. 900, MCF88, No. 33, No. 40, No. 45, No. 52, MA7, MA8, MA100, or No. 2200B (manufactured by Mitsubishi Chemical Corporation); Raven 5750, Raven 5250, Raven 5000, Raven 3500, Raven 1255, or Raven 700 (manufactured by Carbon Columbia); Regal 400R, Regal 330R, Regal 660R, Mogul L, Monarch 700, Monarch 800, Monarch 880, Monarch 900, Monarch 1000, Monarch 1100, Monarch 1300, or Monarch 1400 (manufactured by CABOT JAPAN K.K.); Color Black FW1, Color Black FW2, Color Black FW2V, Color Black FW18, Color Black FW200, Color Black 5150, Color Black 5160, Color Black 5170, Printex 35, Printex U, Printex V, Printex 140U, Special Black 6, Special Black 5, Special Black 4A, or Special Black 4 (manufactured by Degussa).

Although a white pigment is not particularly limited, for example, there may be mentioned C.I. Pigment White 6, 18, or 21, or a white inorganic pigment, such as titanium oxide, zinc oxide, zinc sulfide, antimony oxide, magnesium oxide, or zirconium oxide, may be mentioned. As a pigment other than those white inorganic pigments, a white organic pigment, such as white hollow resin particles or white polymer particles, may also be used.

Although a pigment to be used for a yellow ink is not particularly limited, for example, there may be mentioned C.I. Pigment Yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, or 180.

Although a magenta pigment is not particularly limited, for example, there may be mentioned C.I. Pigment Red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, or 245; or C.I. Pigment Violet 19, 23, 32, 33, 36, 38, 43, or 50.

Although a cyan pigment is not particularly limited, for example, there may be mentioned C.I. Pigment Blue 1, 2, 3, 15, 15:1, 15:2, 15:3, 15:34, 15:4, 16, 18, 22, 25, 60, 65, or 66; or C.I. Vat Blue 4 or 60.

In addition, although pigments to be used for color inks other than magenta, cyan, and yellow are not particularly limited, for example, there may be mentioned C.I. Pigment Green 7 or 10; C.I. Pigment Brown 3, 5, 25, or 26; C.I. Pigment Orange 1, 2, 5, 7, 13, 14, 15, 16, 24, 34, 36, 38, 40, 43, or 63.

Although a pearl pigment is not particularly limited, for example, there may be mentioned a pigment, such as titanium dioxide-coated mica, argentine, or bismuth oxychloride, having a pearly gloss or an interference gloss.

Although a metallic pigment is not particularly limited, for example, there may be mentioned particles formed from a single component, such as aluminum, silver, gold, platinum, nickel, chromium, tin, zinc, indium, titanium, or copper, or an alloy thereof.

The content of the pigment is, with respect to 100 percent by mass of the ink composition, preferably 0.4 to 12 percent by mass, more preferably 1 to 8 percent by mass, and further preferably 2 to 5 percent by mass.

Resin Particles

The ink composition of this embodiment contains resin particles. Accordingly, the fixability and the abrasion resistance of the image can be improved.

Although the type of resin is not particularly limited, for example, a homopolymer or a copolymer formed from (meth)acrylic acid, a (meth)acrylate, acrylonitrile, cyano acrylate, acrylamide, an olefin, styrene, vinyl acetate, vinyl chloride, vinyl alcohol, a vinyl ether, vinyl pyrrolidone, vinyl pyridine, vinyl carbazole, vinyl imidazole, or vinylidene chloride; a fluorine resin, or a natural resin may be mentioned. Among those resins, at least one of a (meth) acrylic resin and a styrene-(meth)acrylic acid copolymer resin is preferable, at least one of an acrylic resin and a styrene-acrylic acid copolymer resin is more preferable, and a styrene-acrylic acid copolymer resin is further preferable. In addition, the above copolymer may be any one of a random copolymer, a block copolymer, an alternate copolymer, and a graft copolymer.

Although not particularly limited, for example, the above resin can be obtained by the following preparation methods, and if needed, at least two thereof may be used in combination. As the preparation methods, for example, there may be mentioned a method in which polymerization (emulsion polymerization) is performed by mixing a polymerization catalyst (polymerization initiator) and a dispersant with a monomer which is a component forming a desired resin; a method in which after a solution obtained by dissolving a resin having a hydrophilic portion in an water-soluble organic solvent is mixed with water, the water-soluble organic solvent is removed by distillation or the like; and a method in which a solution obtained by dissolving a resin in a water-insoluble organic solvent is mixed with a dispersant in an aqueous solution.

The content of the resin is preferably 1 to 15 percent by mass, more preferably 2 to 10 percent by mass, and further preferably 3 to 7 percent by mass. When the content of the resin is set in the range described above, while the abrasion resistance is improved, the resin can be stably dissolved, and the ejection stability can be improved.

Water

The ink composition of this embodiment contains water. As the water, for example, pure water, such as ion-exchanged water, ultrafiltrated water, reverse osmosis water, or distilled water, or water, such as ultrapure water, in which ionic impurities are removed as much as possible may be mentioned. In addition, when water sterilized, for example, by UV irradiation or by addition of hydrogen peroxide is used, in the case of long-term storage of a pigment dispersion liquid and an ink using the same, the generation of fungi and bacteria can be suppressed.

Although the content of the water is not particularly limited, in this embodiment of the invention, the ink composition preferably contains water in an amount larger than that of a solvent (organic solvent) which will be described below. In addition, since the ink composition is a so-called "aqueous ink", as a solvent component contained in the ink, water is used at least as an important component. The content of the water is, with respect to 100 percent by mass of the aqueous ink composition, preferably 40 to 95 percent by mass, more preferably 45 to 90 percent by mass, and further preferably 50 to 80 percent by mass.

Organic Solvent Having Normal Boiling Point of 180° C. TO 250° C.

The ink composition preferably contains an organic solvent having a normal boiling point of 180° C. to 250° C. Accordingly, evaporation of the organic solvent contained in the ink composition in the head is prevented, and the clogging of the nozzles can be prevented. In addition, when being adhered onto the recording medium, the organic solvent can be rapidly evaporated, and in the ink non-absorptive recording medium or the ink low-absorptive recording medium, a sufficient image quality can be obtained.

As the organic solvent, a nitrogen-containing solvent may also be contained. In addition, the nitrogen-containing solvent has a function to promote softening of the resin particles contained in the ink composition and tends to improve the adhesion even when the heating temperature is low.

Although the nitrogen-containing solvents are not particularly limited, for example, there may be mentioned a pyrrolidone-based, an imidazolidinone-based, an amide ether-based, a pyridine-based, a pyradine-based, and a pyridone-based solvent. In addition, the pyrrolidone-based solvent is preferable, and for example, 2-pyrrolidone, N-methyl-2-pyrrolidone, and N-ethyl-2-pyrrolidone may be mentioned. The nitrogen-containing solvents may be used alone, or at least two thereof may be used in combination.

As the above organic solvent, other organic solvents other than the nitrogen-containing solvents may also be contained. The other organic solvents mentioned above are each preferably a polyol compound, more preferably an alkanediol, and further preferably an alkanediol having 3 to 7 carbon atoms. Although the other organic solvents are not particularly limited, for example, there may be concretely mentioned an alcohol and a glycol, such as ethylene glycol, diethylene glycol, triethylene glycol, propylene glycol, dipropylene glycol, 1,3-propanediol, 1,2-butandiol, 1,2-pentanediol, 1,2-hexanediol, 1,4-butanediol, 1,5-pentanediool, 1,6-hexanediol, diethylene glycol mono-n-propyl ether, ethylene glycol mono-iso-propyl ether, diethylene glycol mono-iso-propyl ether, ethylene glycol mono-n-butyl ether, ethylene glycol mono-t-butyl ether, diethylene glycol mono-n-butyl ether, triethylene glycol monobutyl ether, diethylene glycol mono-t-butyl ether, propylene glycol monomethyl ether, propylene glycol monoethyl ether, propylene glycol mono-t-butyl ether, propylene glycol mono-n-propyl ether, propylene glycol mono-iso-propyl ether, propylene glycol mono-n-butyl ether, dipropylene glycol mono-n-butyl ether, dipropylene glycol mono-n-propyl ether, dipropylene glycol mono-iso-propyl ether, methanol, ethanol, n-propyl alcohol, iso-propyl alcohol, n-butanol, 2-butanol, tert-butanol, iso-butanol, n-pentanol, 2-pentanol, 3-pentanol, and tert-pentanol. Those solvents may be used alone, or at least two types thereof may be used in combination.

The content of the organic solvent having a normal boiling point of 180° C. to 250° C. is, with respect to the total mass of the ink, preferably 3.0 percent by mass or more, more preferably 5.0 to 35 percent by mass, and further preferably 10 to 35 percent by mass. Accordingly, when being adhered to the recording medium, the organic solvent can be rapidly evaporated, and in the ink non-absorptive recording medium or the ink low-absorptive recording medium, a sufficient image quality can be obtained.

Organic Solvent Having Normal Boiling Point of More Than 280° C.

In the ink composition of this embodiment, the content of an organic solvent having a normal boiling point of more than 280° C. is 3 percent by mass or less. When the ink composition contains the organic solvent having a normal boiling point of more than 280° C., the drying property of the ink on the recording medium is seriously degraded. As a result, in various recording media, and in particular, in the ink non-absorptive recording medium or the ink low-absorptive recording medium, the density irregularity of the image is not only apparently observed but also the fixability of the ink cannot be obtained.

The content of the organic solvent having a normal boiling point of more than 280° C. in the ink composition is, with respect to the total mass of the ink composition, preferably 2 percent by mass or less, more preferably 1 percent by mass or less, even more preferably 0.5 percent by mass or less, particularly preferably 0 to less than 0.1 percent by mass, further preferably 0 to less than 0.05 percent by mass, even further preferably 0 to less than 0.01 percent by mass, and most preferably 0 to less than 0.001 percent by mass. When the content is in the range described above, the abrasion resistance of a recorded material formed by using the ink composition is suppressed from being degraded by the organic solvent having a normal boiling point of more than 280° C., and a recorded material more excellent in abrasion resistance can be obtained.

Surfactant

The ink composition of this embodiment preferably contains a surfactant. Although the surfactant is not particularly limited, for example, an acetylene glycol-based surfactant, a fluorine-containing surfactant, and a silicone-based surfactant may be mentioned. Among those surfactants, the acetylene glycol-based surfactant and the silicone-based surfactant are preferable.

Although the acetylene glycol-based surfactant is not particularly limited, for example, at least one type selected from 2,4,7,9-tetramethyl-5-decyne-4,7-diol, an alkylene oxide adduct thereof, 2,4-dimethyl-5-decyne-4-ol, and an alkylene oxide adduct thereof is preferable. Although a commercially available product of the acetylene glycol-based surfactant is not particularly limited, for example, there may be mentioned Olefin 104 series or E series, such as Olefin E1010 (trade name, manufactured by Air Products Japan, Inc.); or Surfynol 465, Surfynol 61, or Surfynol DF110D (trade name, manufactured by Nissin Chemical Industry Co., Ltd.). The acetylene glycol-based surfactants may be used alone, or at least two types thereof may be used in combination.

Although the fluorine-containing surfactant is not particularly limited, for example, there may be mentioned a perfluoroalkyl sulfonic acid salt, a perfluoroalkyl carboxylic acid ester, a perfluoroalkyl phosphoric acid ester, a perfluoroalkyl ethylene oxide adduct, a perfluoroalkyl betaine, or a perfluoroalkyl amine oxide compound. Although a commercially available product of the fluorine-containing surfactant is not particularly limited, for example, there may be mentioned S-144 or S-145 (manufactured by Asahi Glass Co., Ltd.); FC-170C, FC-430, or Fluorad FC4430 (manufactured by Sumitomo 3M Limited); FSO, FSO-100, FSN, FSN-100, or FS-300 (manufactured by DuPont); or FT-250 or 251 (manufactured by Neos Co., Ltd.). The fluorine-containing surfactants may be used alone, or at least two types thereof may be used in combination.

As the silicone-based surfactant, for example, a polysiloxane-based compound or a polyether modified organosiloxane may be mentioned. Although a commercially available product of the silicone-based surfactant is not particularly limited, for example, there may be concretely mentioned BYK-306, BYK-307, BYK-333, BYK-341, BYK-345, BYK-346, BYK-347, BYK-348, or BYK-349 (trade name, manufactured by BYK Japan KK); or KF-351A, KF-352A, KF-353, KF-354L, KF-355A, KF-615A, KF-945, KF-640, KF-642, KF-643, KF-6020, X-22-4515, KF-6011, KF-6012, KF-6015, or KF-6017 (trade name, manufactured by Shin-Etsu Chemical Co., Ltd.).

The content of the surfactant is, with respect to 100 percent by mass of the ink composition, preferably 0.1 to 2.0 percent by mass, more preferably 0.1 to 1.7 percent by mass, and further preferably 0.1 to 1.5 percent by mass. Since the content of the surfactant is 2.0 percent by mass or less, the abrasion resistance tends to be further improved. In addition, since the content of the surfactant is 0.1 percent by mass or more, the covering property of an obtained recorded material is further improved, and in addition, the ejection stability tends to be further improved.

Other Components

In order to preferably maintain the storage stability of the ink used in this embodiment and the ejection stability thereof from the head, to improve the clogging resistance, and/or to prevent the degradation of the ink, various additives, such as a dissolution auxiliary agent, a viscosity adjuster, a pH adjuster, an antioxidant, an antiseptic agent, a fungicide, a corrosion inhibitor, and a chelating agent trapping metal ions which adversely influence the dispersibility, may be appropriately added to the ink of this embodiment.

Ink Jet Apparatus

FIG. 1 is a schematic cross-sectional view showing one example of an ink jet apparatus used for the ink jet recording method according to this embodiment. As shown in FIG. 1, an ink jet apparatus 100 includes an ink jet head 2, an IR heater 3, a platen heater 4, an after heater 5, a cooling fan 6, a pre-heater 7, and a ventilation fan 8.

The ink jet head 2 includes a plurality of nozzle lines. In each nozzle line, a plurality of nozzle holes is arranged. The ink jet apparatus 100 is a so-called serial type ink jet apparatus. In the serial type ink jet apparatus, a head is mounted on a carriage which is moved in a predetermined direction, and when the head is moved in association with the movement of the carriage, liquid droplets are ejected onto a recording medium.

When the ink composition is ejected from the ink jet head 2, in order to heat a recording medium 1, the ink jet apparatus 100 shown in FIG. 1 includes the IR heater 3 and the platen heater 4 provided under a platen 9. In an ink composition adhesion step, when the recording medium is heated, at least one of the IR heater 3 and the platen heater 4 may be used.

In addition, by the use of the IR heater 3, the recording medium can be heated from an ink jet head 2 side. Accordingly, although the ink jet head 2 is likely to be simultaneously heated, compared to the case in which the recording medium is heated from a rear side thereof by the platen heater or the like, the temperature can be increased without being influenced by the thickness of the recording medium. In addition, when the platen heater 4 is used, the recording medium can be heated from a side opposite to the ink jet head 2 side. Accordingly, the ink jet head 2 is relatively unlikely to be heated.

The after heater 5 is a heater which dries and solidifies the ink composition recorded on the recording medium 1. Since the after heater 5 heats the recording medium 1 on which an image is recorded, moisture and the like contained in the ink composition are more rapidly evaporated and scattered, and a film can be formed from polymer particles contained in the ink composition. As described above, an ink dried material is strongly fixed (adhered) onto the recording medium, so that a high quality image having an excellent abrasion resistance can be obtained within a short time. A drying temperature by the after heater 5 is preferably 40° C. to 120° C., more preferably 60° C. to 100° C., and further preferably 70° C. to 90° C.

The ink jet apparatus 100 may also include the cooling fan 6. After being dried, the ink composition on the recording medium is cooled by the cooling fan 6, so that a film having a good adhesion to the recording medium tends to be formed.

In addition, the ink jet apparatus 100 may also include the pre-heater 7 which heats (pre-heats) the recording medium in advance before the ink composition is ejected onto the recording medium. Furthermore, the ink jet apparatus 100 may also include the ventilation fan 8 so that the ink composition adhered to the recording medium is more efficiently dried.

Figure 2:
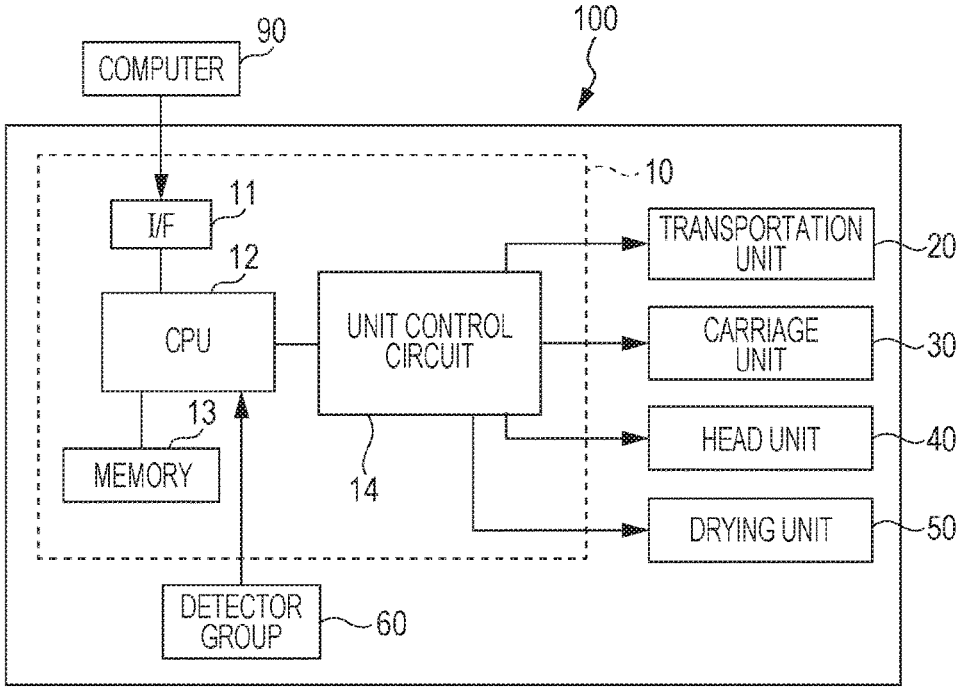
FIG. 2 is a block diagram of the ink jet apparatus used for the ink jet recording method of this embodiment.

FIG. 2 is a functional block diagram of the ink jet apparatus 100.

A controller 10 is a control unit controlling the ink jet apparatus 100. An interface portion 11 (I/F) has a function to send and receive data between a computer 90 and the ink jet apparatus 100. A CPU 12 is an arithmetic processing device controlling the entire ink jet apparatus 100. A memory 13 has a function to secure a region storing the program of the CPU 12, an operation region, and the like. The CPU 12 controls every unit by a unit control circuit 14. In addition, the state in the ink jet apparatus is monitored by a detector group 60, and based on the detection result thereof, the controller 10 controls every unit.

A transportation unit 20 functions to control sub-scanning (transportation) of ink jet recording and, in particular, functions to control a transportation direction and a transportation rate of the recording medium 1. In particular, a rotation direction and a rotation rate of a transportation roller driven by a motor are controlled, so that the transportation direction and the transportation rate of the recording medium 1 are controlled.

A carriage unit 30 functions to control a main scanning (pass) of ink jet recording and, in particular, functions to reciprocally move the ink jet head 2 in a main scanning direction. The carriage unit 30 includes a carriage mounting the ink jet head 2 and a carriage movement mechanism which reciprocally moves the carriage.

A head unit 40 functions to control an ejection amount of the reaction liquid or the ink composition from the nozzle of the ink jet head. For example, when the nozzle of the ink jet head is driven by a piezoelectric element, the operation of the piezoelectric element of each nozzle is controlled. A time from the adhesion of the reaction liquid to the adhesion of the ink and a dot size of the reaction liquid are controlled by the head unit 40. In addition, by the combination between the control of the carriage unit 30 and that of the head unit 40, the adhesion amount of the reaction liquid per one scanning can be controlled.

A drying unit 50 functions to control the temperatures of the various heaters, such as the IR heater 3, the pre-heater 7, the platen heater 4, and the after heater 5.

The ink jet apparatus 100 described above alternately performs an operation of moving the ink jet head in the main scanning direction and the transportation operation (sub-scanning). In this case, when each pass is performed, the controller 10 controls the carriage unit 30 to move the ink jet head 2 in the main scanning direction and also controls the head unit 40 to eject liquid droplets of the reaction liquid or the ink composition from a predetermined nozzle hole of the head 2, so that the liquid droplets of the reaction liquid or the ink composition are adhered to the recording medium 1. In addition, when the transportation operation is performed, the controller 10 controls the transportation unit 50 to transport the recording medium 1 in a transportation direction by a predetermined transportation amount.

Since the pass and the transportation operation are repeatedly performed, a recording region to which a plurality of liquid droplets (dots) is adhered is gradually transported. Next, by the after heater 5, the liquid droplets adhered to the recording medium are dried, so that image formation is completed. Subsequently, the completed recorded material thus obtained may be wound in a roll form by a winding mechanism (not shown) or may be transported by a flat bed mechanism (not shown).

Recording Medium

In this embodiment, as the recording medium, a non-absorptive recording medium or a low-absorptive recording medium may be used. In the non-absorptive recording medium or the low-absorptive recording medium, as the degree of low absorption or the degree of non-absorption is increased, the covering property is liable to be degraded by repletion of an aqueous ink composition. Hence, for the recording medium as described above, the ink jet recording method according to this embodiment is advantageously used.

Incidentally, the "low-absorptive recording medium" or the "non-absorptive recording medium" indicates a recording medium defined by Bristow's method such that a water absorption amount for 30 milliseconds from the start of contact is 10 $mL/m^2$ or less. This Bristow's method is a most popular method as a method for measuring a liquid absorption amount in a short time and is also employed by Technical Association of the Pulp and Paper Industry, Inc. (Japan TAPPI). The detail of the test method is described in "Standard No. 51 "Paper and Paperboard-Liquid Absorption Test Method-Bristow's Method", of "JAPAN TAPPI PAPER AND PULP TEST METHODS, 2000".

In addition, the non-absorptive recording medium or the low-absorptive recording medium may also be classified by the wettability of a recording surface thereof to water. For example, a water droplet having a volume of 0.5 μL is dripped on a recording surface of a recording medium, and the rate in decrease of contact angle (comparison between a contact angle measured at 0.5 milliseconds after landing and that measured at 5 seconds after landing) is measured, so that the recording medium can be characterized. In more particular, as the property of the recording medium, the non-absorption property of the "non-absorptive recording medium" indicates that the above rate in decrease is less than 1%, and the low absorption property of the "low-absorptive recording medium" indicates that the above rate in decrease is 1% to less than 5%. In addition, the absorptive property indicates that the above rate in decrease is 5% or more. In addition, the contact angle may be measured, for example, by using a portable contact angle meter PCA-1 (manufactured by Kyowa Interface Science Co., Ltd.).

Although the low-absorptive recording medium is not particularly limited, for example, a coated paper having a coating layer which receives an oily ink as a surface layer may be mentioned. Although the coated paper is not particularly limited, for example, book printing paper, such as art paper, coat paper, or matte paper, may be mentioned.

Although the non-absorptive recording medium is not particularly limited, for example, a plastic film having no ink absorbing layer or a film formed of a base material, such as paper, and a plastic coated thereon or a plastic film adhered thereto may be mentioned. As the plastic mentioned above, for example, there may be mentioned a poly(vinyl chloride), a poly(ethylene terephthalate), a polycarbonate, a polystyrene, a polyurethane, a polyethylene, or a polypropylene.

Besides the recording media described above, an ink non-absorptive recording medium or an ink low-absorptive recording medium, such as a metal plate formed of iron, silver, copper, aluminum, or the like, or glass, may also be used.

Ink Jet Recording Method

An ink jet recording method of this embodiment includes a reaction liquid adhesion step of ejecting from the ink jet head 2, a reaction liquid in the form of liquid droplets containing an aggregating agent which aggregates an ink composition so as to adhere the reaction liquid to a recording region of the recording medium 1 which is a non-absorptive recording medium or a low-absorptive recording medium; and a color ink adhesion step of ejecting the ink composition in the form of liquid droplets from the ink jet head 2 so as to adhere the ink composition to the recording region of the recording medium 1 to which the reaction liquid is adhered, and the reaction liquid adhesion step is carried out by performing relative scanning (hereinafter, also referred to as "main scanning" or "pass" in some cases) between the ink jet head 2 and the recording medium 1 a plurality of times.

Reaction Liquid Adhesion Step

The reaction liquid adhesion step is a step of adhering the reaction liquid containing an aggregating agent which aggregates the ink composition to the recording medium. The aggregating agent has a function to aggregate the ink composition by reaction with a pigment contained in the ink composition, a pigment dispersion resin contained therein, and the like. Accordingly, the generation of bleeding and the like of an image recorded using the ink composition can be suppressed, and an image having an excellent image quality can be obtained. Since the reaction liquid is adhered by performing the main scanning (pass) a plurality of times, the drying of the reaction liquid on the recording medium is advanced between the passes, so that an excellent image quality is obtained.

In addition, in the reaction liquid adhesion step, on a recording region of the recording medium having predetermined distances extending in the main scanning direction and the sub-scanning direction (however, the predetermined distance in the sub-scanning direction is shorter than a transportation distance of the recording medium by one sub-scanning performed in the recording), relative scanning between the ink jet head and the recording medium is performed a plurality of times. That is, in the recording, the nozzle line also faces a plurality of times, every point in the recording region of the recording medium in the sub-scanning direction.

In particular, when positions of the recording medium to which liquid droplets of the reaction liquid are adhered are each called a pixel position (simply called "pixel" in some cases), at least one type of relative scanning between the ink jet head and the recording medium to be performed a plurality of times for pixels which belong to one pixel line extending in the main scanning direction of the recording region and relative scanning between the ink jet head and the recording medium to be performed a plurality of times for pixels which belong to one pixel line extending in the sub-scanning direction of the recording region is preferably performed, and more preferably, the above two types of relative scanning are both performed.

Accordingly, since the adhesion of the liquid droplets to the pixels which belong to one pixel line is performed by a plurality of passes, the liquid droplets are separately adhered by a plurality of passes, and the drying of the reaction liquid is advanced between the passes, so that an excellent image quality is obtained.

For the adhesion of the liquid droplets to the pixels which belong to one pixel line by performing a plurality of passes, the liquid droplets may be separately adhered to different pixels which belong to one pixel line by performing a plurality of passes, and/or the liquid droplets may be repeatedly adhered to the same pixel by performing a plurality of passes. In the latter case, the amount of the reaction liquid to be adhered to the same pixel may be divided by the number of passes and then adhered thereto by each pass.

Figure 3:
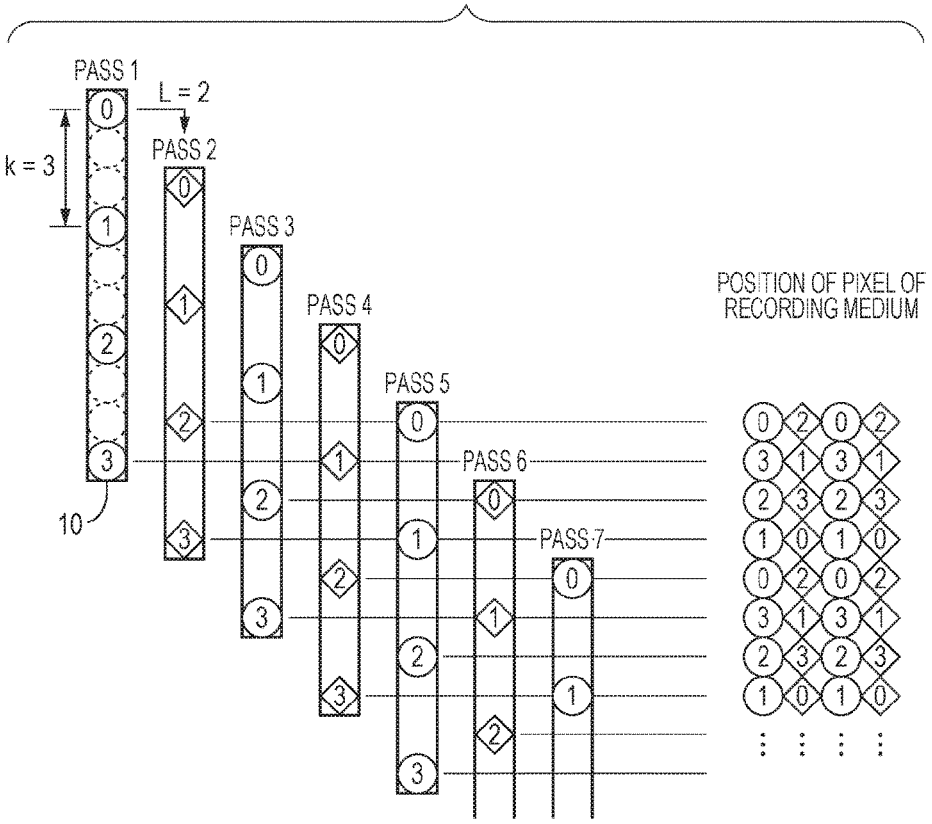
FIG. 3 is a schematic view showing one example of the ink jet recording method of this embodiment.

FIG. 3 is a schematic view illustrating one example of the reaction liquid adhesion step of this embodiment. For easy understanding of the figure, in FIG. 3, the number of nozzles of the nozzle line is set to 4. The passes (main scanning or scanning) of the nozzle line to the recording medium are performed in a left to right direction in the figure. Since the sub-scanning is performed between one pass and a subsequent pass so that a relative position between the nozzle line and the recording medium is shifted in a sub-scanning direction (an up to down direction in the figure), while the pass and the sub-scanning are alternately performed in accordance with an increase in pass number, the position of the nozzle line in the sub-scanning direction relative to that of the recording medium is sequentially shifted in a down direction in the figure. In FIG. 3, although the nozzle line is shown as if shifted in the down direction in the figure, in the actual adhesion step, the nozzle line is not shifted in the sub-scanning direction, and the recording medium may be moved (transported) in the up direction shown in the figure along the sub-scanning direction.

In FIG. 3, the resolution (dpi) of the pixels on the recording medium/nozzle resolution (dpi)=k is 3. A value L obtained by counting a distance of the nozzle line moved in the sub-scanning direction by one sub-scanning using the number of pixels of the recording medium in the sub-scanning direction is 2. In FIG. 3, the liquid droplets are adhered to pixels of one pixel line extending in the main scanning direction by two passes, and the liquid droplets are adhered to pixels of one pixel line extending in the sub-scanning direction by three passes. The number of the passes of the latter is a value of k. The number described at the position of the pixel of the recording medium indicates that the liquid droplet adhered thereto is ejected from the nozzle having the same number as described above. The number of passes is not limited to that shown in FIG. 3, and when the number of nozzles in one nozzle line and/or the value L is changed, the number of passes may also be changed.

The upper limit of the surface temperature of the recording medium in the reaction liquid adhesion step is preferably 45° C. or less and more preferably 38° C. or less. Although the lower limit of the surface temperature of the recording medium in the adhesion step is not particularly limited, the lower limit is preferably 20° C. or more, more preferably 25° C. or more, and further preferably 30° C. or more. When low-temperature heating is performed on the recording medium in the reaction liquid adhesion step as described above, the reaction liquid recorded by a previous pass can be suppressed from being rapidly dried, so that the difference in degree of drying between the reaction liquid recorded by a first pass and that recorded by a final pass can be reduced. In addition, by the low-temperature heating, since the drying of dots of the reaction liquid recorded by a previous pass is advanced, and the dot diameters thereof are slightly decreased, the dots are not likely to be brought into contact with dots of the reaction liquid recorded by a subsequent step, or even if the dots are brought into contact with each other, dots which are slightly dried to some extent are not likely to gather together. Hence, the reaction liquid is uniformly adhered to the recording medium, and the ink droplets and the reaction liquid are reliably brought into contact with each other, so that an excellent image quality can be obtained. In addition, since the ink is able to stably react, the recording region is stably covered with the ink, and as a result, a recorded material excellent in color stability can be obtained without causing the problem in which the ink color of the recorded material is slightly changed by each recording.

Furthermore, since the amount of radiation heat from the platen is small or zero, the drying of the ink composition in the ink jet head and the change in composition thereof can be suppressed, and hence, the clogging of the head can be prevented.

The recording medium 1 is preferably heated by the pre-heater 7 provided at an upstream side in the recording medium transportation direction than the platen 9 which supports the recording medium when the reaction liquid is adhered thereto, and the reaction liquid is then adhered to the recording medium 1 thus heated. Since the recording medium is heated at a low temperature by the pre-heater 7, the advantage described above can be obtained.

The number of scanning in the reaction liquid adhesion step is preferably 2 to 10 times. Accordingly, while the adhesion amount of the reaction liquid per one scanning is set to small, the total adhesion amount of the reaction liquid per unit area can be secured, and the image quality in the recording region of the recording medium can be improved. In addition, a time required for the recording can be decreased.

The upper limit of the total adhesion amount of the reaction liquid in the recording region is preferably 4 mg/inch$^2$ or less, more preferably 3 mg/inch$^2$ or less, and further preferably 2.5 mg/inch$^2$ or less. The lower limit of the total adhesion amount of the reaction liquid in the recording region is preferably 0.1 mg/inch$^2$ or more, more preferably 0.2 mg/inch$^2$ or more, further preferably 1.0 mg/inch$^2$ or more, and particularly preferably 1.5 mg/inch$^2$ or more. When the total adhesion amount of the reaction liquid in the recording region is more than the upper limit, the moisture in the reaction liquid is excessive, the rate of reaction with the color ink composition is increased, and the covering property tends to be degraded. When the total adhesion amount of the reaction liquid in the recording region is less than the lower limit, the gap between the reaction liquid droplets is increased, and the ink composition cannot be effectively aggregated, so that the bleeding tends to be generated.

The adhesion amount of the reaction liquid per one scanning is preferably 0.1 to 2 mg/inch$^2$, more preferably 0.2 to 1 mg/inch$^2$, and further preferably 0.3 to 0.8 mg/inch$^2$. When the adhesion amount of the reaction liquid per one scanning is set in the range described above, the aggregation caused by contact between the reaction liquid droplets can be suppressed, so that the reaction liquid can be uniformly adhered to the recording region of the recording medium.

The mass of the reaction liquid per one liquid droplet in the reaction liquid adhesion step is preferably ng/dot or less. The lower limit of the mass of the reaction liquid per one liquid droplet in the reaction liquid adhesion step is preferably 1 ng/dot or more and more preferably 3 ng/dot or more. In addition, the upper limit of the mass of the reaction liquid per one liquid droplet in the reaction liquid adhesion step is preferably 8 ng/dot or less and more preferably 7 ng/dot or less. Accordingly, while the aggregation caused by contact between the reaction liquid droplets is suppressed, the reaction liquid can be uniformly adhered to the recording region of the recording medium.

Ink Composition Adhesion Step

The ink composition adhesion step is a step of ejecting the ink composition in the form of liquid droplets from the ink jet head 2 to the recording medium to which the reaction liquid is adhered so as to adhere the ink composition thereto.

The maximum adhesion amount of the ink composition is preferably 5 to 15 mg/inch$^2$. Accordingly, the components of the ink composition can be sufficiently aggregated by the contact with the reaction liquid, so that the image quality can be improved.

Ink Composition Drying Step

After the ink composition is adhered, by the use of the after heater 5, the recording medium to which the ink composition is adhered is dried. Accordingly, the resin contained in the ink composition on the recording medium is melted, and a recorded material having a good covering property can be formed. In this case, the heating temperature of the recording medium by the after heater 5 is preferably 50° C. to 150° C., more preferably 70° C. to 120° C., and further preferably 80° C. to 100° C. Since the drying temperature is in the range described above, the abrasion resistance tends to be further improved.

According to the ink jet recording method of this embodiment, in an ink jet recording method using a reaction liquid for a recording medium which is a non-absorptive recording medium or a low-absorptive recording medium, in order to uniformly apply the reaction liquid on the recording medium, the reaction liquid is adhered thereto by scanning performed a plurality of times, so that the reaction liquid can be uniformly applied on the recording medium. As a result, the image quality, such as the color stability, the covering property, and the anti-bleeding property, can be improved.

EXAMPLES

Hereinafter, with reference to examples and comparative examples, the invention will be described in more detail. However, the invention is not limited to the following examples.

Preparation of Reaction Liquid

Materials were mixed together to obtain the compositions (percent by mass) shown in the following Table and were then sufficiently stirred, so that various reaction liquids were obtained.

In Table 1, as calcium acetate, calcium acetate monohydrate was used. The mass of calcium acetate in the table indicates a solid component excluding water.

Preparation of Ink Composition

In addition, in this embodiment, as the ink composition, the following compositions shown in Table 2 were used.

TABLE 2

| Color Ink | Ink 1 | Ink 2 |
|---|---|---|
| Cyan Pigment P.B.15:3 | 3 | 3 |
| Resin Joncryl 7610 (Styrene-Acrylic Resin, Manufactured by BASF Japan) (Solid Component) | 3 | 3 |
| 2-Pyrrolidone | 20 | 20 |
| Propylene Glycol | 5 | 3 |
| Glycerin | | 2 |
| Surfactant BYK348 (Manufactured by BYK Japan KK) | 1 | 1 |
| Water | Balance | Balance |
| Total | 100 | 100 |

As shown in Tables 3 and 4, various conditions (the reaction liquid, the color ink, the number of scanning for the reaction liquid, the adhesion amount of the reaction liquid per one scanning, the adhesion amount (total adhesion amount) of the reaction liquid, the temperature of the recording medium, the time from the adhesion of the reaction liquid to the adhesion of the ink, the dot size of the reaction liquid, the recording resolution of the reaction liquid, the type of recording medium, and the presence or absence of the pre-heater) of the ink jet recording method were changed and recorded, and the color stability, the image quality (covering property), the image quality (anti-bleeding property), the abrasion resistance, and the degree of clogging were evaluated. Hereinafter, the conditions of the recording method and the evaluation tests will be described in detail.

TABLE 1

| Reaction Liquid Composition | | | | | | | | | |
|---|---|---|---|---|---|---|---|---|---|
| | | Normal Boiling Point (° C.) | Reaction Liquid 1 | Reaction Liquid 2 | Reaction Liquid 3 | Reaction Liquid 4 | Reaction Liquid 5 | Reaction Liquid 6 | Reaction Liquid 7 |
| Aggregating Agent | Calcium Acetate | | 4.7 (0.3 mol/kg) | 14 | 4.7 | | | 0.3 | 0.3 |
| | Polyallylamine | | | | | 4.7 | | | |
| | Succinic Acid | | | | | | 4.7 | | |
| Organic Solvent | Propylene Glycol | 188 | 5 | 5 | 4 | 5 | 5 | 15 | |
| | 2-Pyrrolidone | 245 | 25 | 25 | 24 | 25 | 25 | 15 | 25 |
| | Glycerin | 290 | | | 2 | | | | |
| | Ethylene Glycol Monomethyl Ether | 124 | | | | | | | 5 |
| | Surfactant BYK348 (Manufactured by BYK Japan KK) | | 1 | 1 | 1 | 1 | 1 | 1 | 1 |
| | Water | | Balance | Balance | Balance | Balance | Balance | Balance | Balance |
| | Total | | 100 | 100 | 100 | 100 | 100 | 100 | 100 |

TABLE 3

| | Recording Example | | | | | | |
|---|---|---|---|---|---|---|---|
| | Example 1 | Example 2 | Example 3 | Example 4 | Example 5 | Example 6 | Example 7 |
| Reaction Liquid No. | Reaction Liquid 1 | Reaction Liquid 2 | Reaction Liquid 3 | Reaction Liquid 4 | Reaction Liquid 5 | Reaction Liquid 6 | Reaction Liquid 7 |
| Ink No. | Ink 1 | Ink 1 | Ink 1 | Ink 1 | Ink 1 | Ink 1 | Ink 1 |
| Number of Scanning for Reaction Liquid | 4 | 4 | 4 | 4 | 4 | 4 | 4 |
| Adhesion Amount of Reaction Liquid per One Scanning (mg/inch2) | 0.5 | 0.5 | 0.5 | 0.5 | 0.5 | 0.5 | 0.5 |
| Adhesion Amount of Reaction Liquid (mg/inch2) (Total Adhesion Amount) | 2 | 2 | 2 | 2 | 2 | 2 | 2 |
| Temperature of Recording Medium (° C.) | 40 | 40 | 40 | 40 | 40 | 40 | 40 |
| Time from Adhesion of Reaction Liquid to Adhesion of Ink (Seconds) | 5 | 5 | 5 | 5 | 5 | 5 | 5 |
| Dot Size of Reaction Liquid (ng/dot) | 5 | 5 | 5 | 5 | 5 | 5 | 5 |
| Recording Resolution of Reaction Liquid (dpi) (Pixel Position) | 720 × 720 | 720 × 720 | 720 × 720 | 720 × 720 | 720 × 720 | 720 × 720 | 720 × 720 |
| Type of Recording Medium | Recording Medium 1 | Recording Medium 1 | Recording Medium 1 | Recording Medium 1 | Recording Medium 1 | Recording Medium 1 | Recording Medium 1 |
| Pre-Heater | Yes | Yes | Yes | Yes | Yes | Yes | Yes |
| Color Stability | A | A | A | A | B | B | B |
| Image Quality (Covering Property) | A | A | A | A | A | B | B |
| Image Quality (Anti-Bleeding Property) | A | A | B | B | B | B | A |
| Abrasion Resistance | A | B | B | A | A | B | A |
| Clogging | A | A | A | C | A | B | A |

| | Example 8 | Example 9 | Example 10 | Example 11 | Example 12 | Example 13 |
|---|---|---|---|---|---|---|
| Reaction Liquid No. | Reaction Liquid 1 | Reaction Liquid 1 | Reaction Liquid 1 | Reaction Liquid 1 | Reaction Liquid 1 | Reaction Liquid 1 |
| Ink No. | Ink 2 | Ink 1 | Ink 1 | Ink 1 | Ink 1 | Ink 1 |
| Number of Scanning for Reaction Liquid | 4 | 4 | 4 | 4 | 4 | 4 |
| Adhesion Amount of Reaction Liquid per One Scanning (mg/inch2) | 0.5 | 0.5 | 0.5 | 0.5 | 0.5 | 0.5 |
| Adhesion Amount of Reaction Liquid (mg/inch2) (Total Adhesion Amount) | 2 | 2 | 2 | 2 | 2 | 2 |
| Temperature of Recording Medium (° C.) | 40 | 40 | 50 | 40 | 40 | 40 |
| Time from Adhesion of Reaction Liquid to Adhesion of Ink (Seconds) | 5 | 5 | 5 | 20 | 5 | 0 |
| Dot Size of Reaction Liquid (ng/dot) | 5 | 9 | 5 | 5 | 5 | 5 |
| Recording Resolution of Reaction Liquid (dpi) (Pixel Position) | 720 × 720 | 720 × 720 | 720 × 720 | 720 × 720 | 720 × 360 | 720 × 720 |
| Type of Recording Medium | Recording Medium 1 | Recording Medium 1 | Recording Medium 1 | Recording Medium 1 | Recording Medium 1 | Recording Medium 1 |
| Pre-Heater | Yes | Yes | Yes | Yes | Yes | Yes |
| Color Stability | A | B | B | B | B | A |
| Image Quality (Covering Property) | A | B | A | B | B | A |
| Image Quality (Anti-Bleeding Property) | C | B | A | B | B | A |
| Abrasion Resistance | B | A | A | A | A | B |
| Clogging | A | A | B | A | A | A |

TABLE 4

| | Recording Example | | | | | | |
|---|---|---|---|---|---|---|---|
| | Example 14 | Example 15 | Example 16 | Example 17 | Example 18 | Example 19 | Example 20 |
| Reaction Liquid No. | Reaction Liquid 5 | Reaction Liquid 1 | Reaction Liquid 1 | Reaction Liquid 1 | Reaction Liquid 1 | Reaction Liquid 1 | Reaction Liquid 1 |
| Ink No. | Ink 1 | Ink 1 | Ink 1 | Ink 1 | Ink 1 | Ink 1 | Ink 1 |
| Number of Scanning for Reaction Liquid | 8 | 4 | 4 | 4 | 8 | 4 | 4 |
| Adhesion Amount of Reaction Liquid per One Scanning (mg/inch2) | 0.25 | 0.5 | 0.5 | 0.5 | 0.25 | 0.5 | 0.25 |
| Adhesion Amount of Reaction Liquid (mg/inch2) (Total Adhesion Amount) | 2 | 2 | 2 | 2 | 2 | 2 | 1 |
| Temperature of Recording Medium (° C.) | 40 | 40 | 40 | 35 | 35 | 30 | 40 |
| Time from Adhesion of Reaction Liquid to Adhesion of Ink (Seconds) | 5 | 5 | 5 | 5 | 5 | 5 | 5 |
| Dot Size of Reaction Liquid (ng/dot) | 9 | 5 | 5 | 5 | 5 | 5 | 5 |
| Recording Resolution of Reaction Liquid (dpi) (Pixel Position) | 720 × 720 | 720 × 720 | 720 × 720 | 720 × 720 | 720 × 720 | 720 × 720 | 720 × 720 |
| Type of Recording Medium | Recording Medium 1 | Recording Medium 2 | Recording Medium 1 | Recording Medium 1 | Recording Medium 1 | Recording Medium 1 | Recording Medium 1 |
| Pre-Heater | Yes | Yes | No | No | No | No | Yes |

TABLE 4-continued

| | Recording Example | | | | | | |
|---|---|---|---|---|---|---|---|
| Color Stability | A | A | B | A | A | A | B |
| Image Quality (Covering Property) | A | A | A | B | A | C | A |
| Image Quality (Anti-Bleeding Property) | A | B | A | B | A | B | B |
| Abrasion Resistance | A | B | A | B | B | B | A |
| Clogging | A | A | B | A | A | A | A |

| | Example 21 | Example 22 | Comparative Example 1 | Comparative Example 2 | Comparative Example 3 | Comparative Example 4 |
|---|---|---|---|---|---|---|
| Reaction Liquid No. | Reaction Liquid 1 | Reaction Liquid 1 | Reaction Liquid 1 | Reaction Liquid 1 | — | Reaction Liquid 1 |
| Ink No. | Ink 1 | Ink 1 | Ink 1 | Ink 1 | Ink 1 | Ink 1 |
| Number of Scanning for Reaction Liquid | 4 | 2 | 1 | 1 | — | 4 |
| Adhesion Amount of Reaction Liquid per One Scanning (mg/inch2) | 1.0 | 1 | 2 | 2 | — | 0.5 |
| Adhesion Amount of Reaction Liquid (mg/inch2) (Total Adhesion Amount) | 4 | 2 | 2 | 2 | — | 2 |
| Temperature of Recording Medium (° C.) | 40 | 40 | 40 | 40 | 40 | 40 |
| Time from Adhesion of Reaction Liquid to Adhesion of Ink (Seconds) | 5 | 5 | 5 | 5 | 5 | 5 |
| Dot Size of Reaction Liquid (ng/dot) | 5 | 5 | 5 | 5 | 5 | 5 |
| Recording Resolution of Reaction Liquid (dpi) (Pixel Position) | 720 × 720 | 720 × 720 | 720 × 720 | 720 × 720 | 720 × 720 | 720 × 720 |
| Type of Recording Medium | Recording Medium 1 | Recording Medium 1 | Recording Medium 1 | Recording Medium 3 | Recording Medium 3 | Recording Medium 3 |
| Pre-Heater | Yes | Yes | Yes | Yes | Yes | Yes |
| Color Stability | A | A | C | A | A | A |
| Image Quality (Covering Property) | B | A | B | A | A | A |
| Image Quality (Anti-Bleeding Property) | A | B | D | A | B | A |
| Abrasion Resistance | A | A | A | D | D | D |
| Clogging | A | A | A | A | A | A |

Conditions of Ink Jet Recording Test Recording Apparatus

As the ink jet apparatus, a modified apparatus SC-S30650 (manufactured by Seiko Epson Corp.) was prepared. A heater of a platen was configured so that the temperature was arbitrarily adjusted. In addition, a pre-heater provided at an upstream side than the platen was also configured so that the temperature was adjusted. A surface temperature of a recording medium to which a reaction liquid was to be adhered was set to the value shown in the table. A surface temperature of the recording medium at a position in a transportation direction thereof at which the reaction liquid was started to be adhered was measured. The reaction liquid was charged in one nozzle line, and the ink was charged in another nozzle line. The nozzle lines each had a nozzle density of 720 dpi.

Recording Method

After the reaction liquid was first ejected from the nozzle line to a recording medium set in the printer to form a test pattern of the reaction liquid, the recording medium was reversely transported and was again set, and the ink was adhered on the test pattern. The recording was performed by alternately repeating a pass (main scanning) and sub-scanning (transportation). A rest period was provided so that a time from the completion of the adhesion of the reaction liquid to predetermined positions in the pattern on the recording medium to the start of the adhesion of the ink was set to the value shown in the table. After the completion of the adhesion of the ink, the recording medium was post-heated by an after heater located at a downstream side than the platen to 80° C. for approximately one minute. After being discharged, the recording medium was left for 12 hours.

Pre-Heater

The difference obtained by the presence or absence of the pre-heater was as follows.

Presence of the pre-heater: the recording medium was pre-heated by the pre-heater provided at an upstream side and was then transported to the platen. The platen heater was also auxiliarily used.

Absence of the pre-heater: the pre-heater was set to off, and the platen heater was only used.

In the recording test, three types of tests were performed by changing the number of passes (the number of scanning) for the reaction liquid as shown below.

4 Passes

A nozzle line having a nozzle density of 360 dpi was prepared using every other nozzle of the nozzle line, dots in one dot line extending in the main scanning direction were formed by 2 passes, and dots in one dot line extending in the sub-scanning direction were formed by 2 passes, so that the recording was performed by totally 4 passes. In addition, the resolution shown in the table was the resolution of pixel positions at which dots could be formed. However, in practice, pixel positions at which no dots were formed were provided so as to set the adhesion amount of the reaction liquid to the value shown in the table, or two dots were formed at the same pixel position so as to adjust the adhesion amount. In addition, the adhesion amount was adjusted so as to be uniform in the pattern as much as possible.

8 Passes

A nozzle line having a nozzle density of 180 dpi was prepared using every fourth nozzle of the nozzle line, dots in one dot line extending in the main scanning direction were formed by 4 passes, and dots in one dot line extending in the sub-scanning direction were formed by 4 passes, so that the recording was performed by totally 8 passes. The other conditions were the same as those described in the 4 passes.

1 Pass

A nozzle line having a nozzle density of 720 dpi was prepared using all the nozzles of the nozzle line, dots in one dot line extending in the main scanning direction were formed by 1 pass, and dots in one dot line extending in the sub-scanning direction were formed by 1 pass, so that the recording was performed by 1 pass. The other conditions were the same as those described in the 4 passes.

In addition, the ink was recorded by 4 passes as was the case of the 4 passes of the reaction liquid. However, the ink amount per one ink liquid droplet was adjusted so that the total adhesion amount was 11 mg/inch$^2$ (the adhesion amount per one scanning was set to ¼ thereof). In addition, recording was also performed by adjusting the ink amount per one ink droplet dot so as to decrease the ink adhesion amount by 1 mg/inch$^2$ each (the adhesion amount per one scanning was set to ¼ thereof). The resolution of the pixel position was set to 720×720 dpi.

Recording Medium

As the recording medium, the following recording media were used.

Recording medium 1: vinyl chloride resin, SV-G-1270G, manufactured by Roland DG Corp., non-absorptive recording medium Recording medium 2: PET50A PL Shin, manufactured by Lintec Corp., non-absorptive recording medium Recording medium 3: high-quality paper, manufactured by Hokuetsu Kishu Paper Co. Ltd., absorptive recording medium After the recording was performed as described above, evaluation tests of the test pattern portion formed on the recording medium were performed. Hereinafter, the evaluation tests will be described below.

Color Stability (ΔE)

First, one test pattern was continuously recorded on 50 recording media having an A4 size. The ink adhesion amount of the pattern was set to 8 mg/inch$^2$. The color of each pattern was measured, and the maximum difference in color (ΔE) was calculated. As a color measurement device, CM-700d manufactured by Konica Minolta Inc. was used. The evaluation criteria are as follows.

A: ΔE is less than 1.0.

B: ΔE is 1.0 to less than 1.5.

C: ΔE is 1.5 or more.

Image Formation (Bleeding)

As the test pattern, a cyan pattern was formed on a reaction liquid pattern by changing the ink adhesion amount. In addition, after a liquid in which 1 percent by mass of the same cyan pigment as that used in the ink was contained in the reaction liquid was separately prepared, recording was performed only by using the liquid thus prepared, and the pattern thus recorded was observed. In Comparative Example 1, since reaction liquid dots in the test pattern further gathered together, and a large area of the recording medium which was the base was observed, it was believed that this was caused by the aggregation of the reaction liquid dots. The evaluation criteria are as follows.

A: No aggregation irregularity is observed in a pattern having an ink adhesion amount of 9 mg/inch$^2$.

B: Aggregation irregularity is not observed in a pattern having an ink adhesion amount of 7 to 8 mg/inch$^2$ but is observed in a pattern having an ink adhesion amount of 9 mg/inch$^2$.

C: Aggregation irregularity is not observed in a pattern having an ink adhesion amount of 5 to 6 mg/inch$^2$ but is observed in a pattern having an ink adhesion amount of 7 mg/inch$^2$.

D: Aggregation irregularity is observed in a pattern having an ink adhesion amount of 6 mg/inch$^2$.

Image Formation (Covering Property)

The test pattern was observed with a loupe (×10 times), and whether the base color of the recording medium in the pattern was observed or not was confirmed. The evaluation criteria are as follows.

A: The base color is not observed by an ink adhesion amount of 8 mg/inch$^2$.

B: The base color is not observed by an ink adhesion amount of 9 to 10 mg/inch$^2$ but is observed by an ink adhesion amount of 8 mg/inch$^2$.

C: The base color is observed by an ink adhesion amount of 11 mg/inch$^2$.

Abrasion Resistance

A test pattern having an ink adhesion amount of 9 mg/inch$^2$ was formed, and the abrasion resistance thereof was evaluated. The evaluation criteria are as follows.

A: The test pattern is not peeled away by rubbing 50 times using a Gukusin-type rubbing tester.

B: The test pattern is partially peeled away (less than 10% of the area) by rubbing 50 times using a Gukusin-type rubbing tester.

C: The test pattern is peeled away (10% to less than 50% of the area) by rubbing 50 times using a Gukusin-type rubbing tester.

D: The test pattern is peeled away (50% or more of the area) by rubbing 50 times using a Gukusin-type rubbing tester.

Clogging

After the nozzle line of the reaction liquid was left for one day without being capped under the conditions of the recording test, cleaning (CL) was performed, and the recovery of the nozzles was evaluated. The reaction liquid in a volume of 0.8 cc was discharged from the nozzle line by one cleaning (CL).

A: Recovery is obtained by performing CL 3 times or less.

B: Recovery is obtained by performing CL 4 to 6 times.

C: Recovery is not obtained by performing CL 6 times.

As shown in Tables 3 and 4, the ink compositions of the examples were all excellent in image quality (anti-bleeding property) and abrasion resistance. Furthermore, the ink compositions of the examples were relatively excellent in color stability, image quality (covering property), and clogging resistance. On the other hand, the ink compositions of the comparative examples were inferior in image quality (anti-bleeding property) and color stability or inferior in abrasion resistance.

In addition, from the results of the examples ands the comparative examples, the following finding was obtained.

From the result of Example 3, when a high boiling point solvent was used as the solvent of the reaction liquid, the anti-bleeding property and the abrasion resistance tended to be degraded.

From the result of Example 7, when a relatively low boiling point solvent was used as the solvent of the reaction liquid, the color stability tended to be slightly degraded.

From the result of Example 8, when a high boiling point solvent was used as the solvent of the ink, the anti-bleeding property tended to be degraded.

From the result of Example 9, when the dot size was increased, the dot density was decreased, and the color stability, the covering property, and the anti-bleeding property tended to be degraded.

From the result of Example 10, when the temperature of the recording medium was high, the color stability tended to be degraded.

From the result of Example 11, when the time from the adhesion of the reaction liquid to the adhesion of the ink was long, the color stability tended to be degraded.

From the result of Example 12, when the dot density was low, the image quality tended to be degraded.

From the result of Example 13, when the time from the adhesion of the reaction liquid to the adhesion of the ink was short, the abrasion resistance tended to be degraded.

From the result of Example 14, when the number of passes was large, the image quality tended to be improved.

From the result of Example 17, when the temperature of the recording medium was low, the color stability and the clogging resistance tended to be improved. In addition, the drying was not sufficient, the gathering of the reaction liquid dots was slightly generated, and the anti-bleeding property tended to be degraded.

From the result of Example 18, when the number of passes was large, the covering property and the image quality tended to be improved.

From the result of Example 19, when the temperature of the recording medium was further decreased, since a large amount of moisture of the reaction liquid remained, the rate of reaction of the ink was increased, and the covering property tended to be degraded.

From the result of Example 20, when the adhesion amount of the reaction liquid was small, the gap between the reaction liquid dots was liable to be generated, and the color stability and the anti-bleeding property tended to be degraded.

From the result of Example 21, when the adhesion amount of the reaction liquid was large, the amount of moisture of the reaction liquid was increased, and the rate of reaction of the ink was increased, so that the covering property tended to be degraded.

From the result of Comparative Example 1, when the reaction liquid was adhered by one pass, the image quality (anti-bleeding property) and the color stability were degraded.

From the results of Comparative Examples 2 and 3, it was found that when recording was performed on the absorptive recording medium, the image quality (anti-bleeding property) and the color stability were not degraded regardless of whether the reaction liquid was adhered by one pass or was not used; however, a recorded material excellent in abrasion resistance could not be obtained.

The entire disclosure of Japanese Patent Application No. 2017-033491, filed Feb. 24, 2017 is expressly incorporated by reference herein.

What is claimed is:

1. An ink jet recording method comprising:

a reaction liquid adhesion step of ejecting from an ink jet head, a reaction liquid in the form of liquid droplets containing an aggregating agent which aggregates a color ink composition so as to adhere the reaction liquid to a recording region of a recording medium which is a non-absorptive recording medium or a low-absorptive recording medium; and a color ink adhesion step of ejecting the color ink composition in the form of liquid droplets from an ink jet head so as to adhere the color ink composition to the recording region of the recording medium to which the reaction liquid is adhered, wherein in the reaction liquid adhesion step, while ejecting the liquid droplets, the ink jet head is scanned a plurality of times so as to be moved relatively with respect to the recording medium;

an adhesion amount of the reaction liquid to the recording region after a single scan by the ink jet head relative to the recording medium is 0.1 to 2 mg/inch$^2$; and a total adhesion amount of the reaction liquid to the recording region after the ink jet head is scanned the plurality of times is 1 to 4 mg/inch$^2$.

2. The ink jet recording method according to claim 1, wherein the recording medium in the reaction liquid adhesion step has a surface temperature of 45° C. or less.

3. The ink jet recording method according to claim 1, wherein the reaction liquid contains 3 percent by mass or more of an organic solvent having a normal boiling point of 180° C. to 250° C., and a content of an organic solvent having a normal boiling point of greater than 250° C. in the reaction liquid is 1% by mass or less.

4. The ink jet recording method according to claim 1, wherein the number of scanning in the reaction liquid adhesion step is 2 to 10 times.

5. The ink jet recording method according to claim 1, wherein the content of the aggregating agent of the reaction liquid is 0.5 to 15 percent by mass.

6. The ink jet recording method according to claim 1, wherein the mass of the reaction liquid per one liquid droplet in the reaction liquid adhesion step is 10 ng/dot or less.

7. The ink jet recording method according to claim 1, wherein the aggregating agent is at least one of a polyvalent metal salt, an organic acid, and a cationic compound.

8. The ink jet recording method according to claim 1, wherein the maximum adhesion amount of the color ink composition is 5 to 15 mg/inch$^2$.

9. The ink jet recording method according to claim 1, further comprising: pre-heating the recording medium by a pre-heater provided at an upstream side in a recording medium transportation direction than a platen which supports the recording medium when the reaction liquid is adhered thereto; and transporting the pre-heated recording medium to the platen.

10. The ink jet recording method according to claim 1, wherein the reaction liquid adhesion step is performed by the scanning and sub-scanning which performs relative movement between the ink jet head and the recording medium in a direction intersecting the scanning direction, and in the recording region of the recording medium in which the distance in a sub-scanning direction is a movement distance in the sub-scanning direction by one sub-scanning, the scanning is performed a plurality of times.

11. The ink jet recording method according to claim 1, wherein in the reaction liquid adhesion step the ink jet head is scanned 4 to 10 times relative to the recording medium.

12. The ink jet recording method according to claim 1, wherein the total adhesion amount of the reaction liquid to the recording region after the ink jet head is scanned the plurality of times is 2 to 4 mg/inch$^2$.

13. The ink jet recording method according to claim 1, wherein the adhesion amount of the reaction liquid to the recording region after a single scan by the ink jet head relative to the recording medium is 0.2 to 1 mg/inch$^2$.

14. The ink jet recording method according to claim 1, wherein the reaction liquid contains a nitrogen-containing solvent in an amount that is 15 to 35% by mass with respect to the total mass of the reaction liquid.

15. The ink jet recording method according to claim 1, wherein an adhesion amount of the ink composition to the recording region is 11 to 15 mg/inch$^2$.

* * * * *